US005854607A

United States Patent [19]

Kinghorn

[11] Patent Number: 5,854,607

[45] Date of Patent: Dec. 29, 1998

[54] ARRANGEMENT FOR SUPPLYING POWER TO MODULAR ELEMENTS OF A PHASED ARRAY ANTENNA

[75] Inventor: Anthony Miles Kinghorn, Edinburgh, United Kingdom

[73] Assignee: GEC-Marconi Avionics (Holdings) Limited, Middlesex, Great Britain

[21] Appl. No.: 593,577

[22] Filed: Jan. 30, 1996

[30] Foreign Application Priority Data

Feb. 3, 1995 [GB] United Kingdom ..... 9502127

[51] Int. Cl.[6] ..... H01Q 21/00

[52] U.S. Cl. ..... 343/853; 343/700 MS

[58] Field of Search ..... 343/853, 700 MS, 343/705, 873, 850, 858, 893; 361/385, 386; H01Q 1/02, 21/00

[56] References Cited

U.S. PATENT DOCUMENTS

| | | | |
|---|---|---|---|
| 4,748,429 | 5/1988 | Aubert | 335/299 |
| 4,998,181 | 3/1991 | Haws et al. | 361/385 |
| 5,030,961 | 7/1991 | Tsao | 343/700 MS |
| 5,532,506 | 7/1996 | Tserng | 343/873 |

FOREIGN PATENT DOCUMENTS

| | | |
|---|---|---|
| 448 318 | 9/1991 | European Pat. Off. . |
| 2257703 | 10/1990 | Japan . |
| 1 491 569 | 11/1977 | United Kingdom . |
| 2 247 783 | 3/1992 | United Kingdom . |

*Primary Examiner*—Hoanganh T. Le
*Attorney, Agent, or Firm*—Spencer & Frank

[57] ABSTRACT

Electrical apparatus comprises a number of modules (4) supplied with eletrical power by ducts (6) which convey cooling fluid between adjacent modules (4).

43 Claims, 2 Drawing Sheets

ARRANGEMENT FOR SUPPLYING POWER TO MODULAR ELEMENTS OF A PHASED ARRAY ANTENNA

BACKGROUND OF THE INVENTION

The present invention relates to antenna apparatus wherein electrical energy, or power, is supplied to a number of cooled electrical modules. The invention is particularly but not exclusively applicable to active phased array antennas comprising a plurality of transmit/receive electrical modules arranged in an array.

In certain antenna applications it is desirable to divide and package electrical apparatus into a number of modules, a module in the context of this specification being a housing containing electrical apparatus, particularly electronic circuitry. Modules are often employed so that apparatus can be sub-divided into units which perform particular functions, enabling the apparatus to be built up from a number of modules which can be selected to operate together and be individually replaced or upgraded. Alternatively, such an arrangement of modules is often employed where electronic apparatus is required to simultaneously perform a number of similar functions. In this case the apparatus will often be divided into a number of identical modules each performing similar functions.

Typically, a module will comprise a single printed circuit board (PCB). However, if RF isolation or heat sinking for the module is required, a module comprising one or more PCBs may be housed in a metallic container the walls of which provide RF screening, and/or a large surface from which heat can be dissipated. Such modules are also desirable for application in unfavourable environmental conditions, protecting circuitry from physical damage, damp and static discharge. These modules find particular application in military environments, and larger units are termed line replaceable units (LRUs).

In applications where it is desirable to limit the overall volume of the electronic apparatus, the modules are packed in a high density formation in a racking system, the modules being separated to provide ducts through which cooling fluid can be circulated to remove any excess heat generated by the modules.

One application where it is particularly advantageous to employ a plurality of modules in a close packed array is in an active phased array radar, where a large number of regularly spaced transmitter and receiver elements are employed. In such applications one or more transmitter/receiver elements can be packaged into a number of identical, or similar, modules. Such an antenna may typically comprise one thousand or more individual transmitter/receiver units. These often have to be packaged to a very high density, especially in space critical airborne applications. This limits the amount of space available between adjacent modules, severely limiting the ability to remove the heat from the array of modules by conventional air cooling techniques. This is particularly a problem as each module may typically dissipate several watts of heat energy. It has been proposed that, in an active phased array antenna arrangement, heat be conducted away from the modules by means of a plurality of flat tubes running through the array, sandwiched between adjacent modules. The heat generated by the modules is then conveyed from the array by the liquid to a suitable heat exchanger.

An arrangement as described above enables very close packing of modules to be achieved, each of which in use receives a relatively large electrical current. Because of the need for high packaging density, the modules in the above described antenna arrangement have a relatively small free end face to which the necessary electrical connections have to be made. This problem is further compounded by the close proximity of adjacent modules.

SUMMARY OF THE INVENTION

According to a first aspect of the present invention there is provided antenna apparatus comprising a number of electrical modules and at least one cooling duct having an outer surface in thermal contact with the number of modules, wherein electrical power is supplied to at least one module by means of at least one cooling duct.

By employing the present invention, electrical power can be supplied to a module, or preferably a plurality of modules, by means of the cooling duct. This is particularly advantageous where the modules are packed in a close density formation, for it reduces the number of electrical connections required to be made to the free end face of modules in an array. Furthermore, the cooling duct is normally in contact with a number of modules, and preferably the duct provides a common electrical power supply to these modules. Although the electrical power supplied to the module would normally be a power supply for the module, the electrical power supplied could be any electrical signal.

Preferably at least some of the modules receive, by means other than the cooling duct, control input signals of low power relative to the power received via the cooling duct. This enables control input signals to be applied by means of a connector of lower rating than would be necessary if power were also to be supplied to a module via the same connection means. Modules can then plug directly into a printed circuit baseboard, or similar, which board would not otherwise be capable of conducting the higher currents required to provide the modules with an electrical power supply. Each control signal would normally be associated with one respective module.

Alternatively control signals can be provided to one or more modules by an optical fibre, thereby eliminating the possibility of cross talk or other interference.

The material of the duct may be electrically conductive and convey electrical power to the modules, in which case it is preferable that the cooling fluid is electrically non-conducting. Alternatively, or in addition, the duct may comprise one or more electrically conductive tracks by which electrical power is supplied to the modules. If the primary material of the duct is electrically conductive, it is preferable that the tracks are insulated from the duct by an electrically insulating layer having a relatively high thermal conductivity. The provision of tracks on the duct enables different power supplies or signals to be conveyed to the modules.

The invention is particularly advantageous where a number of modules are arranged in an array with adjacent columns or rows of the array separated by cooling ducts, as this provides a particularly effective cooling with both sides of each duct being in thermal contact with a respective module.

A phased array antenna embodying the invention is particularly advantageous, for it enables a high packing density of antenna elements to be achieved. Preferably each module comprises a transmitter and/or receiver, a relatively low power RF reference signal input and a control signal input, each module in use, in response to a respective control signal, generating a relatively high power radio frequency signal, the power required for generating the RF signal being supplied by means of the cooling duct. In this way the high power electrical connections are made by means of the cooling duct such that only low power RF reference signal and control signal connections need be made to each antenna module by other means.

According to a second aspect of the invention there is provided a method of supplying electrical power to a number of electronic modules of an antenna arrangement comprising arranging a plurality of said modules in thermal contact with at least one cooling duct and supplying electrical power to at least one module by means of at least one cooling duct.

BRIEF DESCRIPTION OF SUMMARY

One embodiment of the present invention will now be described, by way of example only, with reference to the accompanying figures in which like numerals are used to designate like components, and of which:

FIG. 1 is a partially cut-away perspective view of an active phased array antenna in accordance with the present invention; and FIG. 2 is a close-up perspective view of the modules and cooling ducts of the antenna illustrated in FIG. 1.

DETAILED DESCRIPTION OF THE INVENTION

Figure 1:
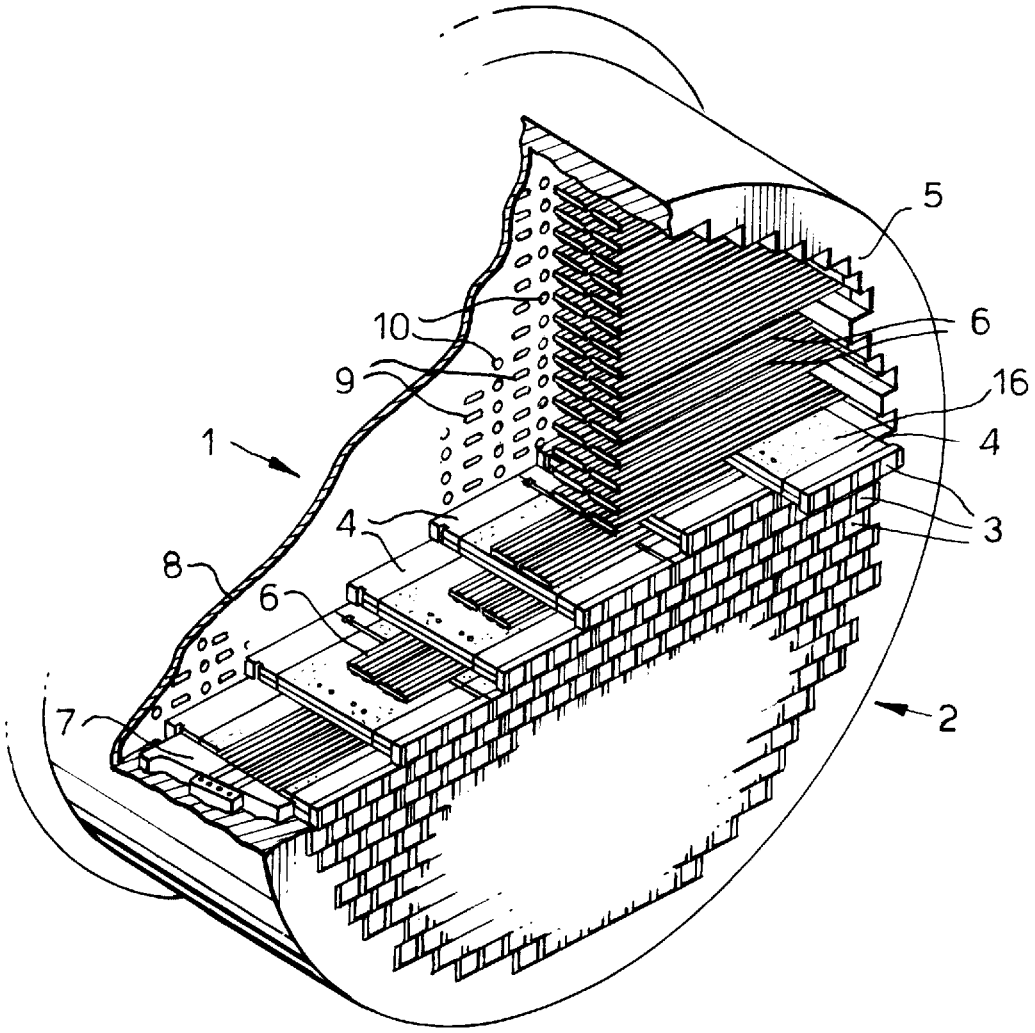

Referring to FIG. 1, an antenna 1 has a front face 2 comprising antenna elements 3 mounted on the front face of electronic modules 4. Each module 4 is stacked in the frame or housing 5 of the antenna, and between each adjacent layer of modules 4 there are positioned cooling ducts 6 which terminate in manifolds 7. The manifolds 7 are in turn connected to a cooling system (not shown) behind rear face 8 of the antenna, which cooling system circulates the fluid inside the ducts 6, removing heat from the modules 4. The rear face 8 of the antenna is provided with a number of multi-pin, or alternatively optical fiber connectors 9 and coaxial RF connectors 10 which co-operate with corresponding connectors (not shown) located on the rear of modules 4 when the modules 4 are slid into position within the antenna housing 5.

Figure 2:
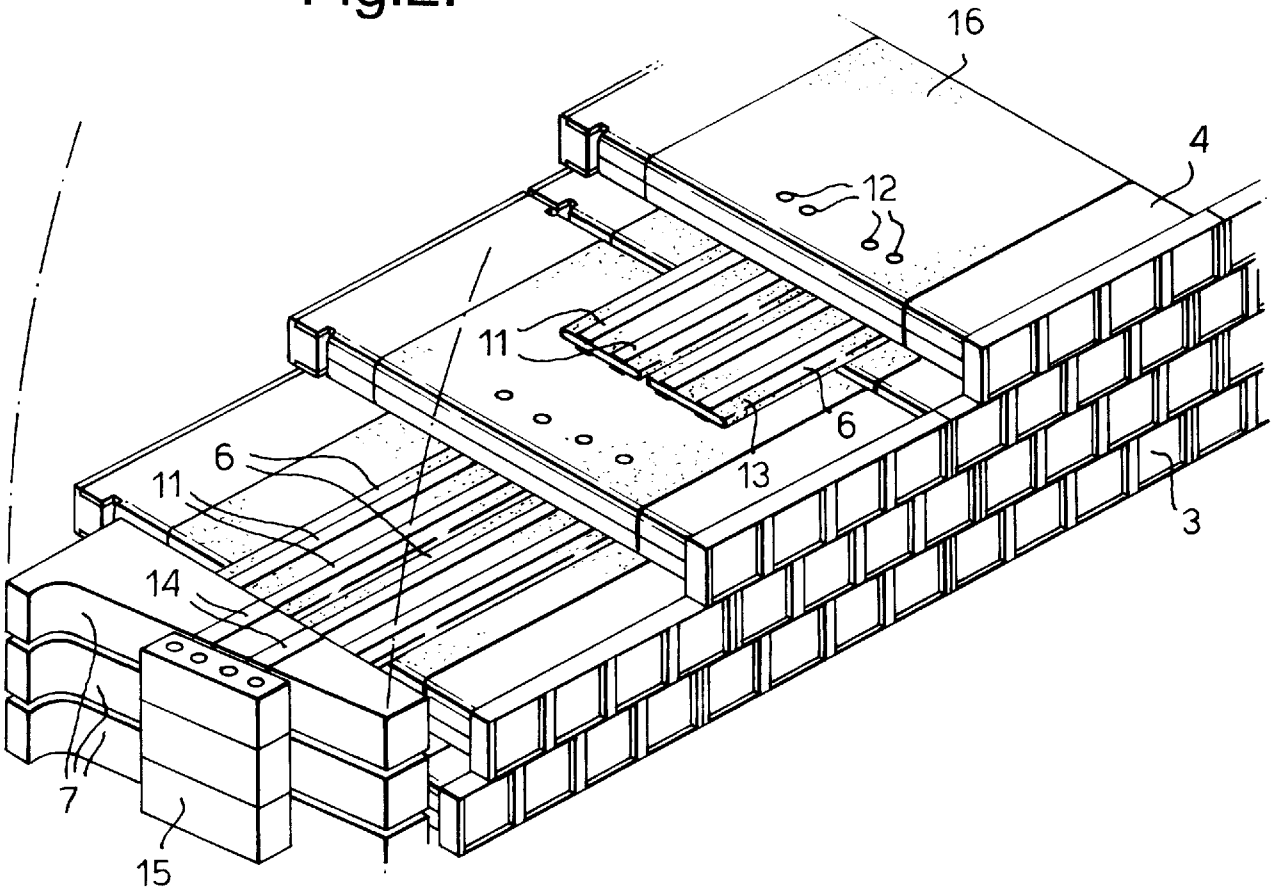

Referring now to FIG. 2, most of the modules 4 comprise four antenna elements 3, however this is not essential and certain of the modules within the antenna 1 will only contain two elements. Each antenna element has associated with it a transmitter and receiver connected to the antenna element by a duplexer. Each module 3 receives an RF reference frequency via coaxial connector 10 (see FIG. 1), and is controlled by control signals received through connector 9 (see FIG. 1). Only low power control signals are transmitted through the connector 9 and so the connector itself is fairly small, having a low current rating. Alternatively as each module receives a power supply from the duct the control signals can be in the form of optical signals transmitted to the module via an optical fibre.

Each module 4 has an electrically insulating, but thermally conductive coating 16 deposited over part of its outer surface. This electrically insulates the modules 4 from conductive tracks 11 on ducts 6. However, contact is made to these conductive tracks 11 by means of contacts 12 on modules 4, and it is through these contacts that the significant power consumed by the module, typically a number of watts, is received.

Each of the ducts 6 comprises a flattened metallic tube constituting an inner electrically conductive layer having an insulating coating 13 on its upper and lower surfaces, on which coating conductive tracks 11 are deposited. Each of the ducts terminates in a manifold 7 with the conductive tracks being connected via wires 14 to connection blocks 15, to which appropriate power supplies are connected via terminals in the antenna casing 5.

In the embodiment illustrated in FIG. 2, conductive tracks 11 are provided on the upper and lower surface of each duct 6, the upper tracks co-operating with further contact pads 12 (not shown) on the lower surface of each module 4, providing eight different connections to each module. The tracks 11 are capable of transmitting a considerable current and therefore are ideal for supplying power to the modules, but can be used to convey any electrical signal common to a number of modules.

In use, the modules are inserted in the antenna with the ducts sandwiched between adjacent modules 4. The modules are held in place by the frame 5 of the antenna and thus the ducts 6 are held in good thermal contact with the modules 4, with the conductive tracks being forced into good electrical contact with contact pads 12.

Although in the embodiment illustrated power is supplied to the modules via conductive tracks 11 on ducts 6, if only a limited number of supply voltages are required the metallic duct, without any electrical insulating coating, could be used to supply electrical power directly to a contact on each module 4. In this arrangement the manifolds would be electrically insulated from the antenna frame and a cooling fluid would be selected with good electrically insulating properties.

Although the present invention has been described and illustrated with respect to an active phased array radar antenna, the invention is equally applicable to any electrical apparatus having a number of modules which need both to be cooled and supplied with electrical power.

What we claim is:

1. Antenna apparatus, comprising:

antenna frame for supporting a plurality of electrical modules;

a plurality of electrical modules each having a front face for transmitting and/or receiving a signal and a rear face inserted in said frame; and at least one cooling duct having an outer surface in thermal contact with the plurality of modules and supplying electrical power to a point on at least one of the modules other than the rear face.

2. Apparatus as claimed in claim 1 wherein the cooling duct provides a common electrical power to said plurality of modules.

3. Apparatus as claimed in claim 1 wherein at least one of the modules receives control input signals of low power relative to power received via the cooling duct which are transmitted independent of the cooling duct.

4. Apparatus as claimed in claim 3 wherein a plurality of control signals are each coupled with at least one respective module.

5. Apparatus as claimed in claim 3, wherein the control signals are applied to the rear face of the modules.

6. Apparatus as claimed in claim 1 wherein at least one module receives an electrical power supply by means of the duct and receives control signals via an optical fibre.

7. Apparatus as claimed in claim 1 wherein the the duct comprises electrically conductive material and conveys electrical power to the modules.

8. Apparatus as claimed in claim 1 wherein cooling fluid in the duct is electrically non-conducting.

9. Apparatus as claimed in claim 1 wherein the duct comprises one or more electrically conductive tracks by which the electrical power is supplied to the modules.

10. Apparatus as claimed in claim 9 wherein the duct comprises an inner layer of electrically conductive material and an electrically insulating layer which has a relatively high thermal conductivity disposed between the conductive tracks and the inner layer of electrically conductive material.

11. Apparatus as claimed in claim 1 wherein a plurality of similar modules are arranged in an array, adjacent columns or rows of the array being separated by cooling ducts.

12. Apparatus as claimed in claim 1 wherein different power supplies are provided by different ducts.

13. Apparatus as claimed in claim 12 wherein at least one module receives at least two different power supplies from respective ducts.

14. A phased array antenna comprising antenna apparatus as claimed in claim 1 wherein each module further comprises: a relatively low power RF reference signal input; and a control signal input, each module in use generating, in response to a respective control signal, a relatively high power radio frequency signal, the power required for generating the RF signal being supplied by means of the cooling duct.

15. A phased array antenna as claimed in claim 14 wherein the electrical modules are arranged in a two dimensional array of electrical modules, each said module comprising an element of the antenna; the at least one cooling duct includes a plurality of cooling ducts sandwiched between adjacent rows or columns of the modules of the array; and the cooling ducts include conductive tracks for supplying electrical power to the modules.

16. A method of supplying electrical power to electrical modules of an antenna arrangement, comprising:

arranging a plurality of said electrical modules in an antenna frame in thermal contact with an outer surface of at least one cooling duct, wherein each electrical module has a front face for transmitting and/or receiving a signal and a rear face inserted in said frame; and supplying electrical power to at least one of the electrical modules by the at least one cooling duct such that electrical power is supplied by the cooling duct to a point on the at least one module other than said rear face.

17. A method as claimed in claim 16 comprising supplying electrical power to a plurality of modules.

18. A method as claimed in claim 17 comprising supplying power to a plurality of modules by a common cooling duct.

19. A method as claimed in claim 16 further comprising supplying to a specific module control signals of low power relative to the power transmitted to a module by the cooling duct which are conducted to the specific module independent of the at least one cooling duct.

20. A method as claimed in claim 19 further comprising applying respective control signals to a plurality of modules.

21. A method as claimed in claim 16 comprising providing an electrical power supply to at least one module by the cooling duct and supplying a control signal to the at least one module via an optical fibre.

22. A method as claimed in claim 16 comprising conveying electrical power to the modules via a cooling duct formed from electrically conductive material.

23. A method as claimed in claim 16 wherein the duct includes conductive tracks and the method further comprises supplying electrical power to the modules by one or more of the conductive tracks on the duct.

24. A method as claimed in claim 23 wherein the cooling duct comprises an inner layer of electrically conductive material which is electrically insulated from the conductive tracks of by an electrically insulating layer, which layer has a relatively high thermal conductivity.

25. A method as claimed in claim 16 comprising supplying electrical power to an array of modules by cooling ducts sandwiched between rows or columns of the array.

26. A method as claimed in claim 16 comprising supplying power to at least one module by two or more ducts.

27. A method as claimed in claim 16 of supplying electrical power to antenna modules of a phased array antenna.

28. Antenna apparatus comprising a number of electrical modules and at least one cooling duct having an outer surface in thermal contact with the number of modules, wherein electrical power is supplied to at least one of the modules by at least one of the cooling ducts and at least one of the modules receives control input signals of low power relative to power received via the cooling duct which are transmitted independent of the cooling duct.

29. Apparatus as claimed in claim 28 wherein a plurality of control signals are each coupled with at least one respective module.

30. Antenna apparatus comprising a number of electrical modules and at least one cooling duct having an outer surface in thermal contact with the number of modules, wherein at least one of the modules receives electrical power by the at least one cooling duct and receives control signals via an optical fiber.

31. Antenna apparatus comprising a number of electrical modules and at least one cooling duct having an outer surface in thermal contact with the number of modules, wherein the at least one cooling duct includes at least one electrically conductive track by which electrical power is supplied to at least one of the modules.

32. Apparatus as claimed in claim 31 wherein the at least one duct comprises an inner layer of electrically conductive material and an electrically insulating layer which has a relatively high thermal conductivity disposed between the at least one conductive track and the inner layer of electrically conductive material.

33. Antenna apparatus comprising a number of similar electrical modules arranged in an array and at least one cooling duct having an outer surface in thermal contact with the number of modules, wherein adjacent columns or rows of the array are separated by the at least one cooling duct and electrical power is supplied to at least one of the modules by the at least one cooling duct.

34. Antenna apparatus comprising a number of electrical modules and a plurality of ducts each having an outer surface in thermal contact with at least one of the modules, wherein electrical power is supplied to the modules by the cooling ducts and different power supplies are provided by different ducts.

35. Apparatus as claimed in claim 34 wherein at least one module receives at least two different power supplies from respective ducts.

36. Antenna apparatus comprising a number of electrical modules and at least one cooling duct having an outer surface in thermal contact with the number of modules, wherein each module includes a relatively low power RF reference signal input and a control signal input, each module in use generating, in response to a respective control signal, a relatively high power radio frequency signal, and the power required for generating the RF signal is supplied by the cooling duct.

37. Apparatus as claimed in claim 36, wherein the apparatus constitutes a phased array antenna with the electrical modules being arranged in a two dimensional array of electrical modules, each said module comprising an element of the antenna; the at least one cooling duct includes a plurality of cooling ducts sandwiched between adjacent rows or columns of the modules of the array; and the cooling ducts include conductive tracks for supplying electrical power to the modules.

38. A method of supplying electrical power to electronic modules of an antenna arrangement, comprising:

arranging a number of said modules in thermal contact with an outer surface of at least one cooling duct;

supplying electrical power to the at least one module by the at least one cooling duct; and supplying to a specific one of the modules, independent of the at least one cooling duct, control signals of low power relative to the power supplied to the specific module by the at least one cooling duct.

39. The method as claimed in claim 38, and further including applying respective control signals to a plurality of the modules.

40. A method of supplying electrical power to electronic modules of an antenna arrangement, comprising:

arranging a number of said modules in thermal contact with an outer surface of at least one cooling duct;

supplying electrical power to at least one of the modules by the at least one cooling duct; and supplying a control signal to the at least one module via an optical fibre.

41. A method of supplying electrical power to electronic modules of an antenna arrangement, comprising:

arranging a number of said modules in thermal contact with an outer surface of at least one cooling duct having conductive tracks thereon; and supplying electrical power to at least one of the modules by at least one of the conductive tracks of the at least one cooling duct.

42. The method as claimed in claim 41, wherein the at least one cooling duct comprises an inner layer of electrically conductive material which is electrically insulated from the conductive tracks by an electrically insulating layer, which layer has a relatively high thermal conductivity.

43. A method of supplying electrical power to electronic modules of an antenna arrangement, comprising:

arranging a number of the modules in an array and in thermal contact with an outer surface of respective cooling ducts sandwiched between rows or columns of the array; and supplying electrical power to the array of modules by the cooling ducts.

* * * * *